US008550227B1

(12) United States Patent
Martin

(10) Patent No.: US 8,550,227 B1
(45) Date of Patent: Oct. 8, 2013

(54) AUTO-POSITIONING SENSORS FOR COIN COUNTING DEVICES

(75) Inventor: Douglas A. Martin, Woodinville, WA (US)

(73) Assignee: Outerwall Inc., Bellevue, WA (US)

( * ) Notice: Subject to any disclaimer, the term of this patent is extended or adjusted under 35 U.S.C. 154(b) by 0 days.

(21) Appl. No.: 13/612,429

(22) Filed: Sep. 12, 2012

(51) Int. Cl.
*G07D 7/00* (2006.01)

(52) U.S. Cl.
USPC ..... 194/302; 194/317; 194/318; 194/319; 194/320; 194/334

(58) Field of Classification Search
USPC ..... 194/209, 212–214, 302, 317–319, 194/328–330, 332, 334, 335, 340, 353; 73/63; 324/600–725
See application file for complete search history.

(56) References Cited

U.S. PATENT DOCUMENTS 5,433,310 A * 7/1995 Bell ..... 194/318
5,975,276 A * 11/1999 Yeh ..... 194/317
6,026,946 A * 2/2000 McCarty, Jr. ..... 194/317
7,520,374 B2 4/2009 Martin et al.
7,865,432 B2 1/2011 Doran et al.
7,874,478 B2 1/2011 Molbak
2001/0008200 A1* 7/2001 Yoshida et al. ..... 194/318
2003/0057054 A1* 3/2003 Waechter ..... 194/334
2009/0166151 A1* 7/2009 Martin et al. ..... 194/317
2010/0330892 A1* 12/2010 Nishida ..... 453/56

OTHER PUBLICATIONS

U.S. Appl. No. 13/269,121, Martin et al.

* cited by examiner

*Primary Examiner* — Jeffrey Shapiro
(74) *Attorney, Agent, or Firm* — Perkins Coie LLP

(57) ABSTRACT

Systems and methods for automatically positioning a coin sensor are disclosed herein. An auto-positioning coin sensor configured in accordance with one embodiment of the disclosure includes a coin sensor for determining a physical characteristic of an object and a moving device operably coupled to the coin sensor. The moving device can be configured to adjust the position of the coin sensor to determine the physical characteristic. Auto-positioning coin sensors in accordance with the present technology can include coin sensors that can be positioned based on a measurement of a dimension of an object.

21 Claims, 9 Drawing Sheets

AUTO-POSITIONING SENSORS FOR COIN COUNTING DEVICES

TECHNICAL FIELD

The following disclosure relates generally to coin sensing systems, and more specifically to coin sensing systems for use in coin counting machines.

BACKGROUND

A number of coin counting devices include sensors to discriminate coin denominations, discriminate coins from different countries, and/or discriminate coins from non-coin objects. These devices can include coin counters, gaming devices such as slot machines, vending machines, bus or subway "fare boxes," etc. In such devices, accurate discrimination of deposited coins is important for economical operation of the device.

Some coin handling devices include electromagnetic sensors to discriminate deposited objects. Generally, these sensors generate an electromagnetic field that interacts with the object. The interactions are analyzed to determine whether the object is a coin, and if so, which denomination it is. In many devices, a coin sensor is positioned proximate to a coin path. As a coin or other object travels along the path, the sensor interacts with the object to discriminate between coins and non-coin objects, and to determine the denominations of the coins. In many devices, the coin sensor is aligned with the approximate center of coins passing by on the coin path. However, due to the differing sizes between various coin denominations, the sensor may not always be sufficiently aligned to accurately discriminate the coins and/or determine coin denominations.

DETAILED DESCRIPTION

The following disclosure describes various embodiments of auto-positioning coin sensors for use with coin counting machines, and associated methods of manufacture and use. In one embodiment, a coin counting machine includes an auto-positioning coin sensor that is positioned adjacent to a coin path. A moving device can automatically adjust the position of the coin sensor to align the sensor with a coin (e.g., the center of the coin) traveling along the coin path and past the sensor. In some embodiments, an additional sensor can be used to determine a physical characteristic of a coin (e.g., the coin diameter), and the auto-positioning coin sensor can be adjusted to align with the center of the passing coin in response to a signal from the additional sensor. Certain details are set forth in the following description and FIGS. 1A-6 to provide a thorough understanding of various embodiments of the disclosure. Other details describing well-known structures and systems often associated with sensor systems and coin counting machines, however, are not set forth below to avoid unnecessarily obscuring the description of the various embodiments of the disclosure.

Many of the details and features shown in the Figures are merely illustrative of particular embodiments of the disclosure. Accordingly, other embodiments can have other details and features without departing from the spirit and scope of the present disclosure. In addition, those of ordinary skill in the art will understand that further embodiments can be practiced without several of the details described below. Furthermore, various embodiments of the disclosure can include structures other than those illustrated in the Figures and are expressly not limited to the structures shown in the Figures. Moreover, the various elements and features illustrated in the Figures may not be drawn to scale.

In the Figures, identical reference numbers identify identical, or at least generally similar, elements. To facilitate the discussion of any particular element, the most significant digit or digits of any reference number refer to the Figure in which that element is first introduced. Element 102, for example, is first introduced and discussed with reference to FIG. 1A.

Figure 1A:
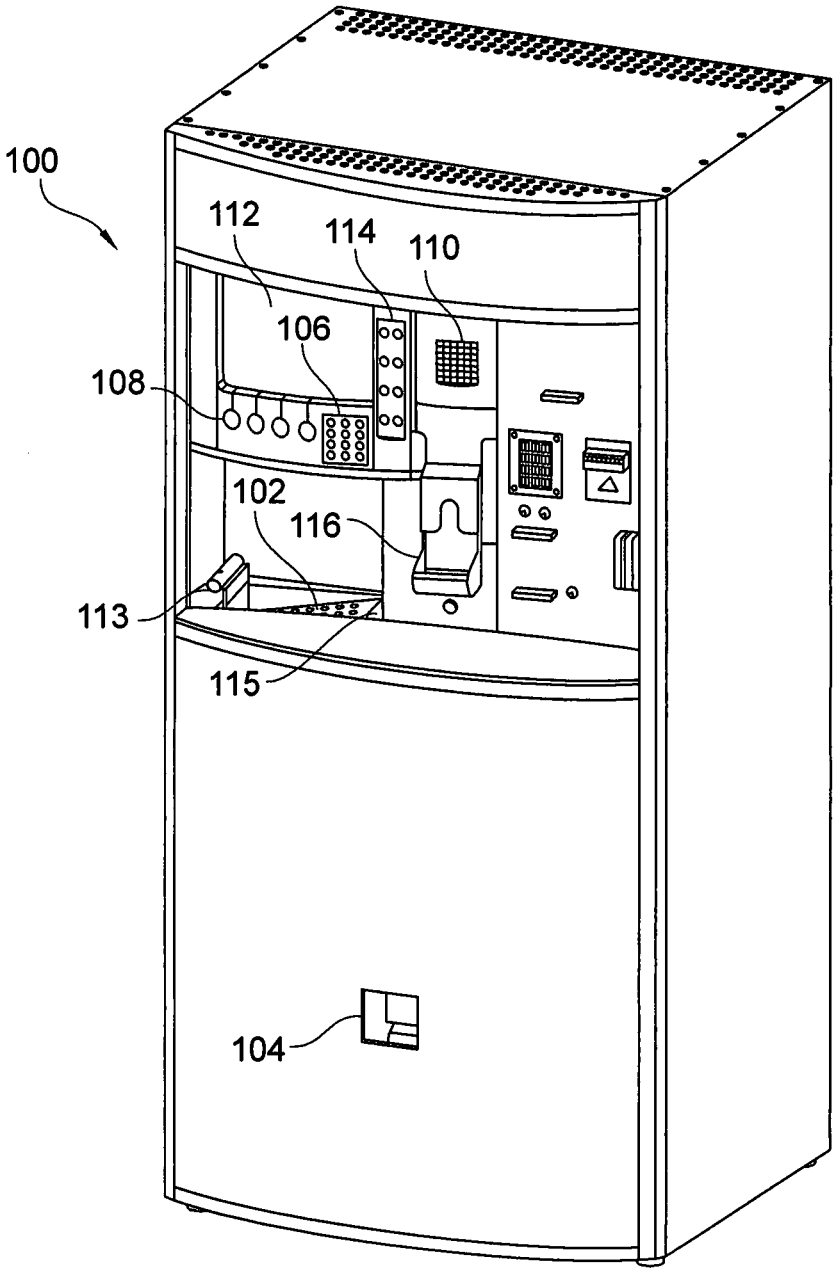
FIG. 1A is an isometric view of a coin counting machine having a coin sensor assembly configured in accordance with an embodiment of the present disclosure.

FIG. 1A is an isometric view of a coin counting machine 100 having a coin sensor assembly configured in accordance with an embodiment of the present disclosure. In the illustrated embodiment, the coin counting machine 100 includes a coin input region or tray 102 and a coin return 104. The tray 102 includes a handle 113 and an output edge 115. The machine 100 further includes various user-interface devices, such as a keypad 106, user selection buttons 108, a speaker 110, a display screen 112, a touch screen 114, and a voucher outlet 116. In other embodiments, the machine 100 can have other features in other arrangements including, for example, a card reader, a card dispenser, etc. Additionally, the machine 100 can include various indicia, signs, displays, advertisements and the like on its external surfaces. The machine 100 and various portions, aspects and features thereof can be at least generally similar in structure and function to one or more of the machines described in U.S. patent application Ser. No. 13/269,121, U.S. Pat. No. 7,520,374, U.S. Pat. No. 7,865,432, and/or U.S. Pat. No. 7,874,478, each of which is incorporated herein by reference in its entirety.

Figure 1B:
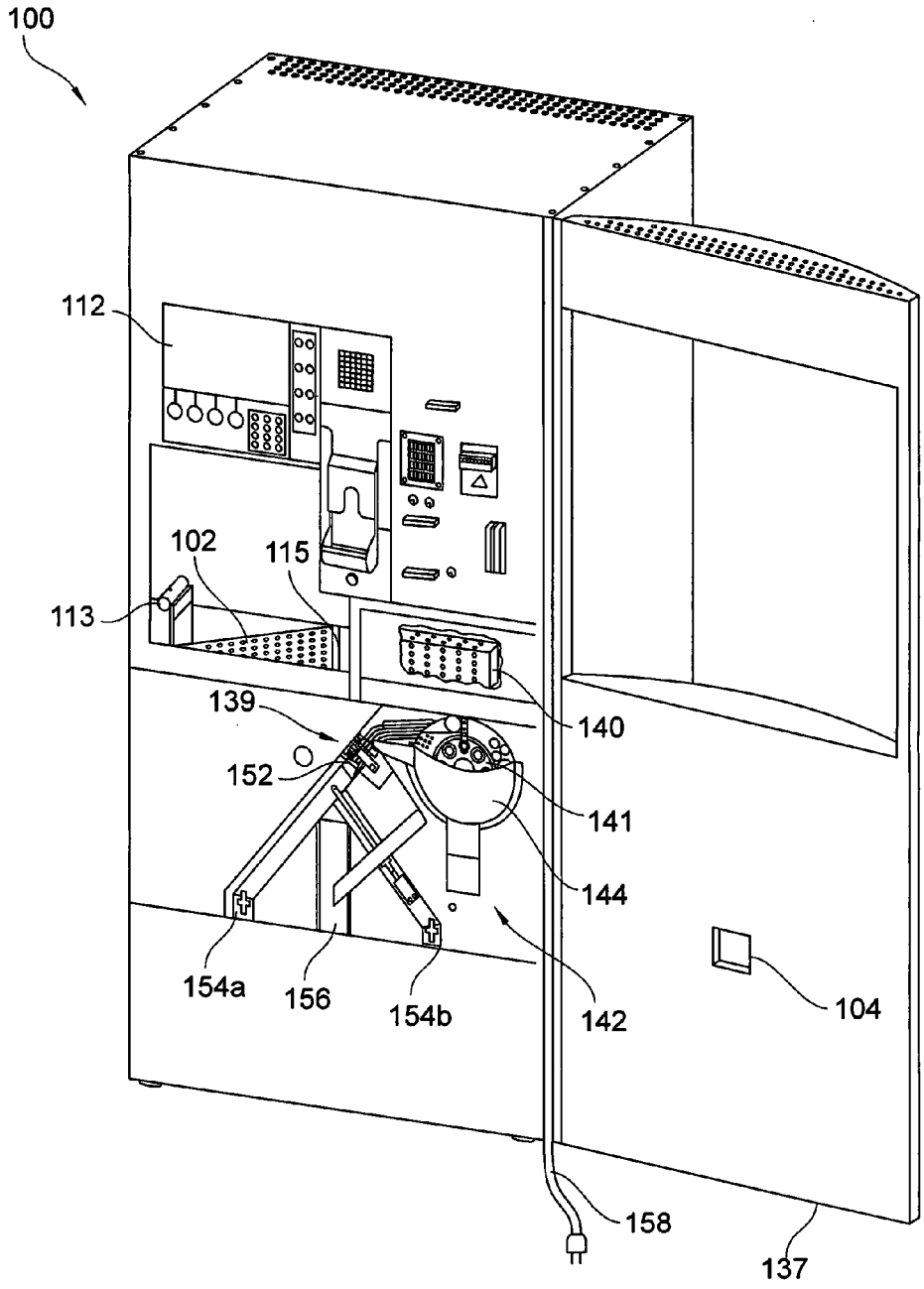
FIG. 1B is a partially cutaway, isometric view of an interior portion of a coin counting machine having an auto-positioning coin sensor assembly configured in accordance with an embodiment of the present disclosure.

FIG. 1B is a partially cutaway, isometric view of an interior portion of the machine 100 having an auto-positioning coin sensor assembly 139 configured in accordance with an embodiment of the present disclosure. For ease of reference, the auto-positioning coin sensor assembly 139 may alternatively be referred to herein as the "sensor assembly 139." The machine 100 includes a door 137 that can rotate to an open position as shown. In the open position, most or all of the components of the machine 100 are accessible for cleaning and/or maintenance. In the illustrated embodiment, the machine 100 includes a coin cleaning portion (e.g., a trommel 140) and a coin counting portion 142. As will be described in more detail below, coins that are deposited into the tray 102 are directed through the trommel 140, and then to the coin counting portion 142. The coin counting portion 142 can include a coin path or coin rail 148 that receives coins from a coin hopper 144 via a coin pickup assembly 141. In the illustrated embodiment, the sensor assembly 139 is positioned adjacent the coin rail 148 upstream of a diverting door 152, a first coin tube 154*a*, a second coin tube 154*b*, and a coin return chute 156. A power cord 158 can provide power to the machine 100. The components of the coin counting portion 142 can be at least generally similar in structure and function to corresponding components described in, for example, U.S. patent application Ser. No. 13/269,121 and U.S. Pat. No. 7,520,374.

In operation, the user places a batch of coins, typically of a plurality of denominations (and potentially accompanied by dirt or other non-coin objects and/or foreign or otherwise non-acceptable coins) in the input tray 102. For ease of discussion in the description that follows, the term coin may be used to describe both coins and coin like objects. Coin like objects may have similar dimensions to coins, and/or have other similar characteristics, and can include blanks, slugs, fake coins, and/or other objects. In one embodiment, the user can be prompted by instructions on the display screen 112 to push a button indicating that the user wishes to have the batch of coins discriminated. An input gate (not shown) opens and a signal prompts the user to begin feeding coins into the machine by lifting or pivoting the tray 102 by handle 113, and/or manually feeding coins over the output edge 115. Instructions on the screen 112 may be used to tell the user to continue or discontinue feeding coins, can relay the status of the machine 100, the amount counted thus far, and/or provide encouragement, advertising, or other messages.

One or more chutes (not shown) direct the deposited coins and/or foreign objects from the tray 102 to the trommel 140. The trommel 140 in the depicted embodiment is a rotatably mounted container having a perforated-wall. A motor (not shown) rotates the trommel 140 about its longitudinal axis. As the trommel rotates, one or more vanes protruding into the interior of the trommel 140 assist in moving the coins in a direction towards an output region. An output chute (not shown) directs the (at least partially) cleaned coins exiting the trommel 140 toward the coin hopper 144.

Figure 2:
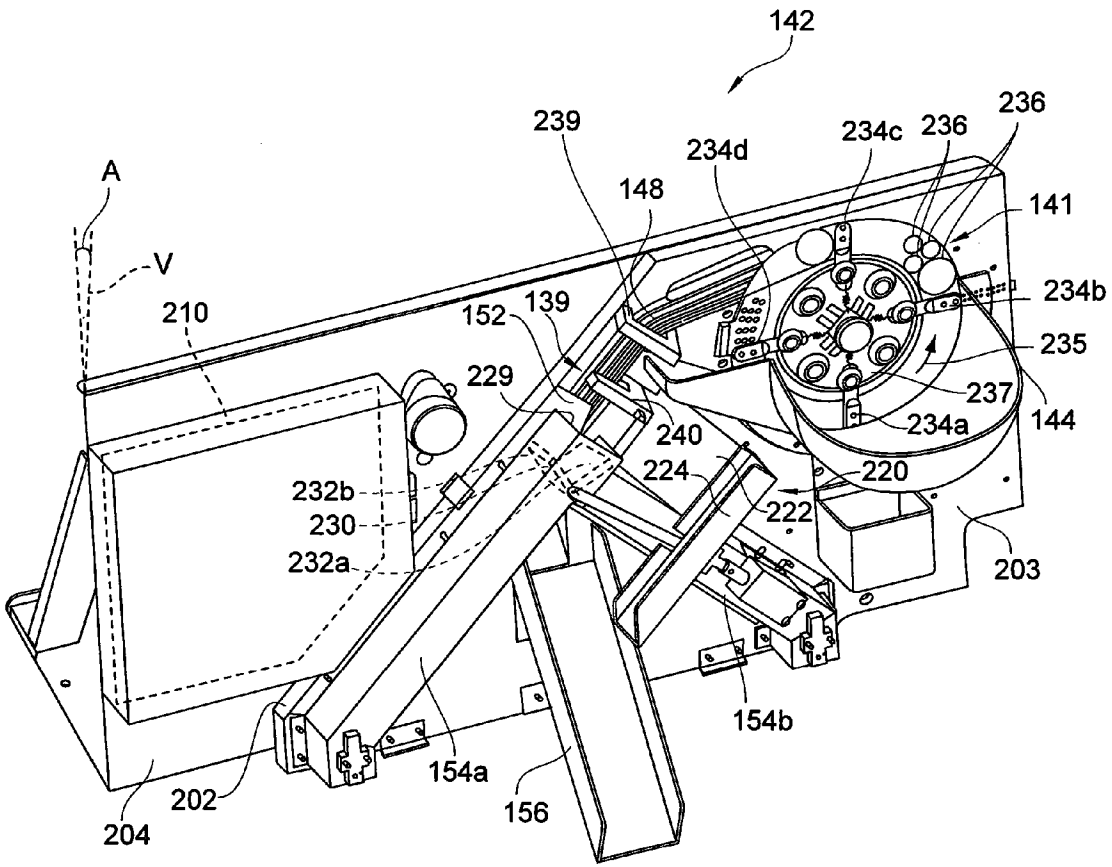
FIG. 2 is a partially schematic, isometric view of a coin counting portion of the coin counting machine of FIGS. 1A and 1B.

FIG. 2 is a partially schematic, enlarged isometric view of the coin counting portion 142 of FIG. 1B illustrating certain features in more detail. In addition to the previously mentioned components, the coin counting portion 142 can include a base plate 202 mounted to a chassis 204. The base plate 202 can be positioned at an angle A of from about 0° to about 15° relative to a vertical line V. The angle A encourages coins 236 to lay relatively flat against a face of the coin rail 148 as they roll down the coin rail 148. A circuit board 210 for controlling operation of various coin counting components can also be mounted to the chassis 204.

The illustrated embodiment further includes a rotating disk 237 disposed in the hopper 144, and having a plurality of paddles 234*a*-234*d*. A detection sensor or first coin sensor 239 can be positioned on the coin rail 148 upstream of the sensor assembly 139, which can include a second coin sensor 240. The first coin sensor can detect or measure an attribute or physical characteristic of a passing coin. For example, in one embodiment, the first coin sensor 239 can include a linear CCD array that measures the diameter of a passing coin. In other embodiments, the first coin sensor 239 can include other light sensing components, audio sensing components (e.g., ultrasonic pairs), mechanical components, and/or other devices or components that can measure a dimension or another characteristic of a passing coin.

The coin rail 148 extends outwardly from the disk 237, past the first coin sensor 239 and the second coin sensor 240, and then toward a chute inlet 229. A deflector plane 222 proximate the second coin sensor 240 is configured to deliver oversized coins to the return chute 156 via a bypass chute 220. The diverting door 152 is disposed proximate the chute entrance 229 and is configured to selectively direct discriminated coins toward the coin tubes 154. A flapper 230 is operable between a first position 232*a* and a second position 232*b* to selectively direct coins to the first delivery tube 154*a* or the second delivery tube 154*b*, respectively.

In operation of the coin counting portion 142, the rotating disk 237 rotates in the direction of arrow 235, causing the paddles 234 to lift the coins 236 from the hopper 144 and place them on the beginning of the rail 148. The coins 236 travel (e.g., roll) along the rail 148 past the first coin sensor 239 and then the second coin sensor 240. The rail 148, the sensor assembly 139, and/or other components can include a ramped portion which can direct coins that are larger than a preselected size parameter (e.g., a certain diameter) to the deflector plane 222, into a trough 224, and then to the return chute 156. Coins within acceptable size parameters continue along the rail 148 and pass through the second coin sensor 240.

As described in greater detail below, in one embodiment the first coin sensor 239 can measure the diameter of the passing coins 236 and the sensor assembly 139 can adjust the position of the second coin sensor 240 based on the diameter to accurately discriminate the coin. The second coin sensor 240 and associated software can determine if the coin is one of a group of acceptable coins and, if so, the coin denomination is counted. This process can include, for example, the second coin sensor 240 producing a magnetic field and measuring changes in inductance as the coin passes through the magnetic field. The changes in inductance can relate to properties of the coin and/or can indicate that a coin has entered or exited the second coin sensor 240. Portions of the coin counting portion 142, the second coin sensor 240, and the methods of denomination determination can be substantially similar in structure and function to the corresponding systems and methods of U.S. Pat. No. 7,520,374. Such systems can be found in, for example, various coin-counting kiosks operated by Coinstar, Inc. of 1800 114th Avenue SE, Bellevue, Wash. 98004.

The majority of undesirable foreign objects (dirt, slugs, etc.) are separated from the coin counting process by the trommel 140 or the deflector plane 222. However, coins or foreign objects of similar characteristics to desired coins may not be separated by the trommel 140 or the deflector plane 222, and thus can pass through the second coin sensor 240. The second coin sensor 240 and the diverting door 152 operate to prevent unacceptable coins (e.g., foreign coins), blanks, or other similar objects from entering the coin tubes 154 and being kept in the machine 100. Specifically, in the illustrated embodiment, the second coin sensor 240 determines if an object passing through the sensor is a desired coin, and if so, the coin is "kicked" by the diverting door 152 toward the chute inlet 229. The flapper 230 is positioned to direct the kicked coin to one of the coin tubes 154 for storage within the machine 100. Coins that are not of a desired denomination, or foreign objects, continue past the second coin sensor 240 to the return chute 156 for collection by the user.

Figure 3:
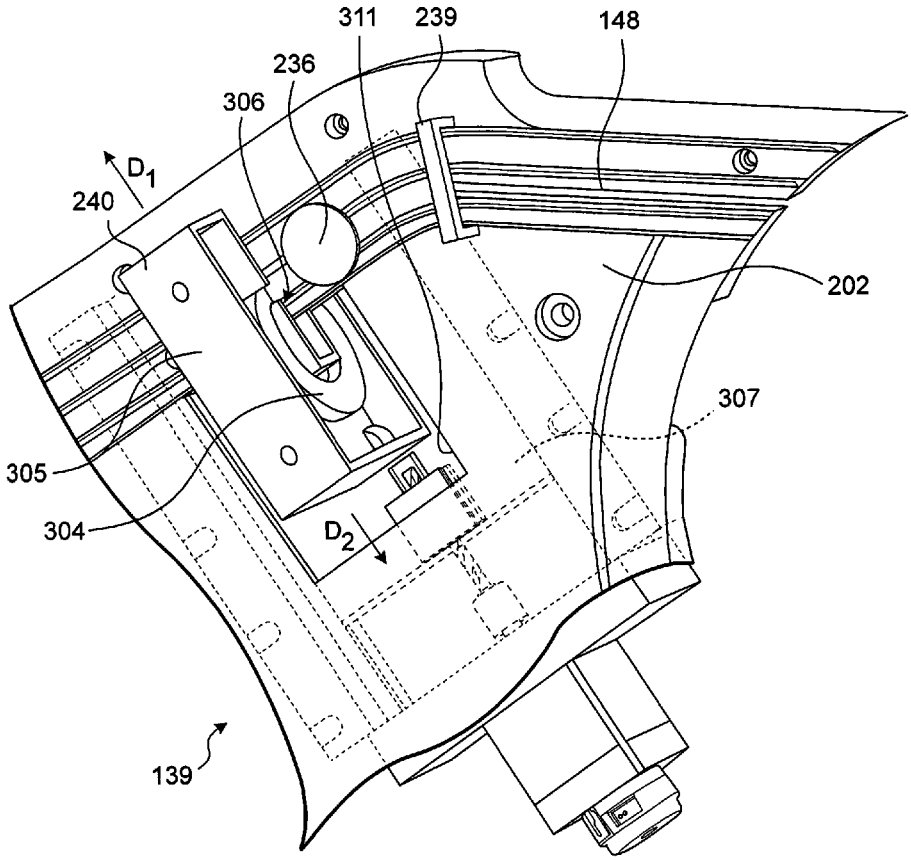
FIG. 3 is a partially schematic, isometric view of a portion of a base plate and an auto-positioning coin sensor assembly configured in accordance with an embodiment of the present disclosure.

FIG. 3 is a partially schematic, isometric view of a portion of the base plate 202 and the auto-positioning sensor assembly 139 configured in accordance with an embodiment of the present disclosure. The second coin sensor 240 can include a core 304 (e.g., a magnetic core) carried by a core housing 305.

The core housing 305 can be attached to a circuit board 307 as an integrated unit. The circuit board 307 can include various electrical components and circuitry for operation of the second coin sensor 240. The integrated design of the circuit board 307 and the second coin sensor 240 can reduce manufacturing costs and reduce cabling and associated signal loss. The base plate 202 can include a cutout 311 for the core housing 305, and the circuit board 307 can be positioned on one side of the base plate 202 while a portion of the core housing 305 and the core 304 can straddle the coin rail 148. In the illustrated embodiment, the core 304 is generally U-shaped and defines a gap 306. The sensor assembly 139 can be operably mounted to the base plate 202 with the coin rail 148 extending through the gap 306. Although the core 304 of the illustrated embodiment is generally U-shaped with opposing faces on opposite sides of the coin rail 148, other embodiments may include a core having a single surface that faces the coin rail 148, or multiple surfaces that face the coin rail 148 from a common side of the coin rail 148. The second coin sensor 240 can be configured to move in a perpendicular, or approximately perpendicular, direction relative to the coin path 148. For example, the second coin sensor 240 can be configured to move in a first direction D1 and a second direction D2 as necessary to best position, or at least favorably position the second coin sensor 240 relative to a particular coin, as will be further described below.

Figure 4:
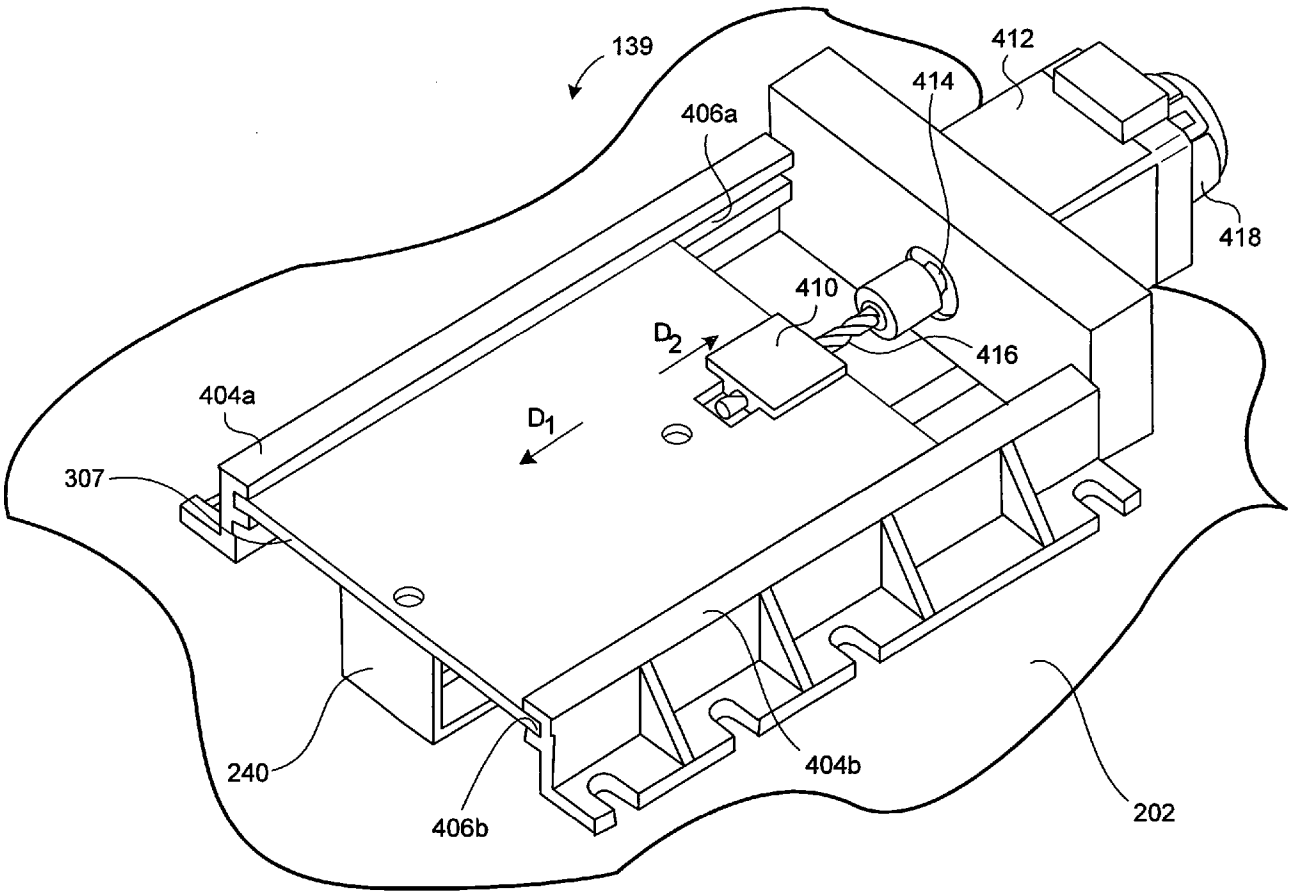
FIG. 4 is a backside isometric view of the auto-positioning coin sensor assembly of FIG. 3.

FIG. 4 is a backside isometric view of the sensor assembly 139 configured in accordance with an embodiment of the present disclosure. In the illustrated embodiment, the sensor assembly 139 includes a first side member 404*a* and an opposing second side member 404*b* (identified collectively as the side members 404). The side members 404 include a first guide rail 406*a* and a second guide rail 406*b*, respectively (identified individually as the guide rails 406). The edges of the circuit board 307 can be slidably received in the guide rails 406 and can slide back and forth in the first direction $D_1$ and the second direction $D_2$. A moving device, e.g., a motor 412, can include an output shaft 414 that can be operably coupled to a lead screw 416. The motor 412 can be an electric motor, e.g., a stepper motor. The lead screw 416 can operably engage a lead nut 410 attached to the circuit board 307. An encoder 418 can be operably coupled to the motor 412, and can provide an indication of the angular position of the output shaft 414, which in turn can correspond to a linear position of the second coin sensor 240 relative to the coin path 148.

Referring to FIGS. 2-4 together, in operation, the coins 236 are lifted from the hopper 144 and delivered to the coin rail 148 by the rotating disk 237. The coins 236 then travel along the rail 148 past the first coin sensor 239. The first coin sensor 239 measures the diameter of each individual passing coin 236 and generates a first signal that corresponds to a diameter of each passing coin 236. The first signal can be sent to a controller to produce a second signal for operation of the motor 412. The controller can send the second signal to the motor 412 to move the second coin sensor 240 in the direction of $D_1$ or $D_2$ as necessary to position the core 304 in alignment with the center of each individual coin 236 as it travels along the coin rail 148 past the second coin sensor 240. The encoder 418 can provide an indication of the position of the second coin sensor 240 to assist in accurate positioning. In some embodiments, the coin counting portion 142 can be configured to position the second coin sensor 240 in any position within a continuous range of positions. In other embodiments, the coin counting portion 142 can be configured with a fixed set of positions for the second coin sensor 240. For example, the coin counting portion 142 can be configured to count and keep only U.S. pennies, nickels, dimes and quarters; and four fixed positions for the second coin sensor 240 can correspond to these coin denominations. The first coin sensor 239 can measure the diameter of each passing coin 236 and the second coin sensor 240 can be positioned in the fixed position that most closely corresponds with the measured diameter. In this manner, the second coin sensor can perform an analysis with an expected result based on the particular fixed position. An analysis that produces a result outside of an expected range can be used to reject the coin 236. In some embodiments, the measurement from the first coin sensor 239 can also be used to reject an individual coin 236.

Although the illustrated embodiments described above include the second coin sensor 240 attached to the circuit board 307, and the circuit board 307 operably coupled to the motor 412 via the lead nut 410, in other embodiments, the second coin sensor 240 can be operably coupled to a motor or other moving device in a variety of different ways. For example, the coin counting portion 142 can be constructed without the circuit board 307 and the second coin sensor 240 can be operably coupled directly to a moving device. In several embodiments, in addition to providing increased accuracy, the moveable second coin sensor 240 can provide "de-jamming" and/or other benefits. For example, in some embodiments, movement of the second coin sensor 240 can aid in removing coins and/or debris that can become stuck between the coin sensor 240 and the coin rail 148, and/or stuck between other components of the machine 100.

In some embodiments, the first coin sensor 239 can measure the diameter of each of several individual coins 236 before any of the coins 236 reach the second coin sensor 240. For example, in one embodiment, the first coin sensor 239 can measure the diameter of each passing coin 236 and generate a first signal for each of the individual coins 236. A series of second signals that each correspond to a position for the second coin sensor 240 can be sent to the motor 412 to sequentially move the second coin sensor 240 into an appropriate position for each individual coin 236. In this manner, the second coin sensor 240 can be centered on one of the coins 236 while several coins are en route to the second coin sensor 240 after being measured by the first coin sensor 239, and while the first coin sensor 239 is measuring the diameter of another one of the coins 236.

In some embodiments, the movement of the second coin sensor 240 can be at least partially based on a time interval that corresponds to the time that it takes for a particular coin to move from the first coin sensor 239 to the second coin sensor 240. For example, if the time for an individual coin 236 to travel from the first coin sensor 239 to the second coin sensor 240 is equal to "t" seconds, the timing of the second signal can be adjusted such that the motor 412 positions the second coin sensor 240 at the appropriate position t seconds after the individual coin 236 passes the first coin sensor 239. For example, the amount of time, t, can be at least partially dependent on the diameter of the individual coin 236, and the timing of the second signal can be adjusted accordingly. The timing of the movement of the second coin sensor 240 can also be at least partially based on a signal from the second coin sensor. For example, in some embodiments, the second coin sensor 240 can detect changes in inductance as a coin approaches and can move to an ordered position in response to the detected change. In other embodiments, an additional sensor (not shown) can be positioned between the first coin sensor 239 and the second coin sensor 240. The additional sensor can provide a third signal indicating that a coin is about to enter the second coin sensor 240. The third signal can be used to initiate the sending of the second signal discussed above.

Although the illustrated embodiment includes the first coin sensor 239 positioned at a distance (e.g., one inch or more) from the second coin sensor 240, in other embodiments, the first coin sensor 239 can be positioned directly adjacent to or proximate to the second coin sensor 240 (e.g., less than one inch). In such embodiments, the first signal from the first coin sensor 239 can be used to indicate that an individual coin 236 that corresponds to the first signal is about to enter the second coin sensor 240. In any of the above embodiments, the timing of the operation of the second coin sensor 240 can be based, at least partially, on the distance between the first coin sensor 239 and the second coin sensor 240. Additionally, the embodiments discussed above represent some of the many possible configurations for the spacing and positioning of coin sensors in accordance with the present disclosure. Accordingly, coin sensors positioned in a variety of suitable manners and using signals of varying timing sequences are in accordance with the spirit and scope of the present disclosure.

Coin counting machines, coin sensors, sensor assemblies, and/or other associated hardware and software in accordance with the present technology can be configured in a variety of suitable manners. For example, in some embodiments, the operation of the sensor assembly 139 can be based on specific countries and/or regions, and the sensor assembly 139 can position the second coin sensor 240 at a particular position based on the characteristics of the set of coins of the specific country or region. In one embodiment, the sensor assembly 139 can position the second coin sensor 240 at a position that provides optimized results for a set of coins from a specific country where the machine may be located (e.g., the United Kingdom). The position for the second coin sensor 240 may also be chosen to enhance accuracy for a set of coins from a given region (e.g., the countries of the eurozone). In these embodiments (and/or in other embodiments), the coin counting machine may not include a first coin sensor 239. Additionally, in some countries or regions, one or more particular denominations of coins may produce a "weak" signal when analyzed by the second coin sensor 240. In some embodiments, the sensor assembly 139 can position the second coin sensor 240 at a position that is chosen to account for the weak signals of these coins. Furthermore, the second coin sensor 240 can be positioned to provide enhanced results for a single denomination of coins. For example, a particular machine 100 may be used to count only U.S. quarters, and the sensor assembly 139 may be configured to position the second coin sensor 240 accordingly (e.g., aligned with the center of the passing U.S. quarters). Such configurations may be temporary or permanent, and can be for any particular currency or denomination.

In some embodiments, the circuit board 307 (and/or other components of the sensor assembly 139 or of the coin counting machine 100) can include firmware and/or software that can adjust the position of the second coin sensor 240 based on the particular location that the sensor assembly is placed into service, or based on the particular set of coins that the machine 100 will be counting. In this manner, a uniform sensor assembly 139 can be used in coin counting machines 100 located in a variety of countries or regions employing different currencies. Additionally, in several embodiments, the position of the second coin sensor 240 can be adjusted to provide for accurate results as additional coins are added to a particular set of currency that the machine 100 has been adjusted for. For example, if a new denomination of coins is added to a country's coin set, the sensor assembly 139 can adjust the position of the second coin sensor 240 to reflect the change. Such updates can be accomplished by loading new software and/or firmware, and/or by other data inputs.

Figure 5A:
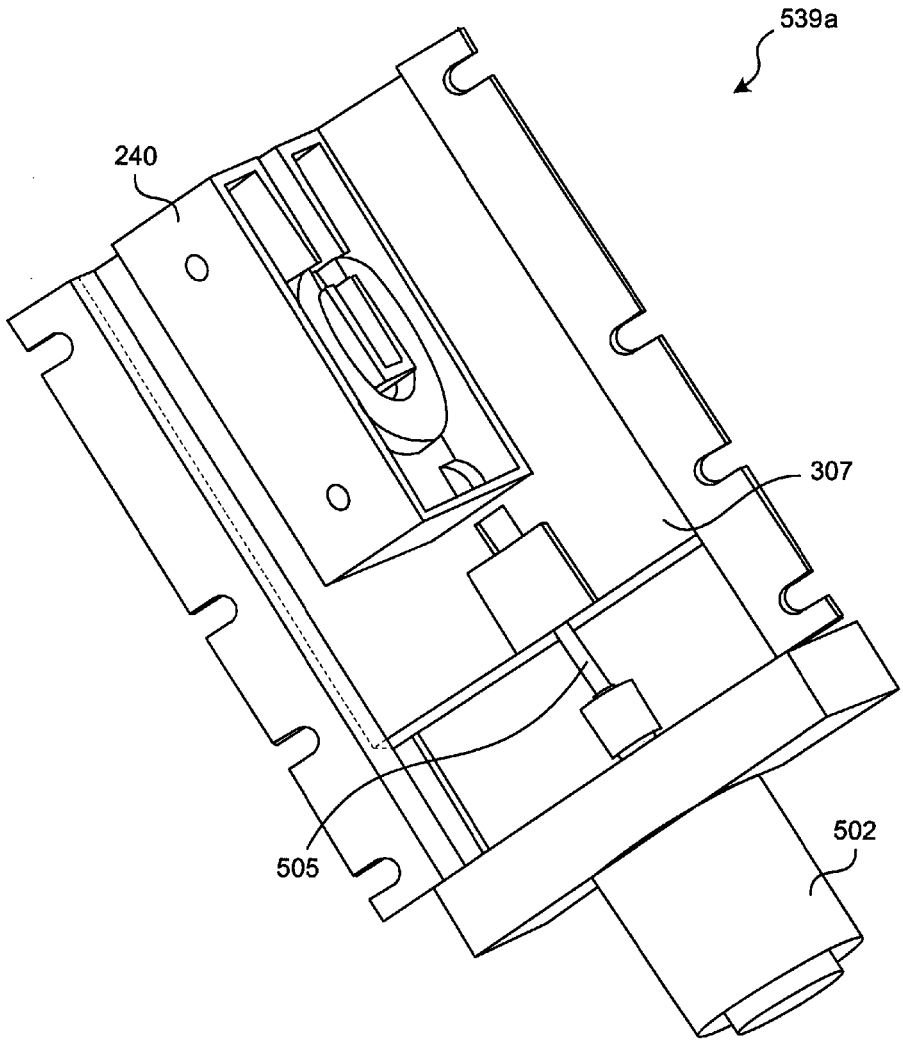
FIGS. 5A-C are front views of auto-positioning coin sensor assemblies configured in accordance with other embodiments of the present disclosure.
Figure 5B:
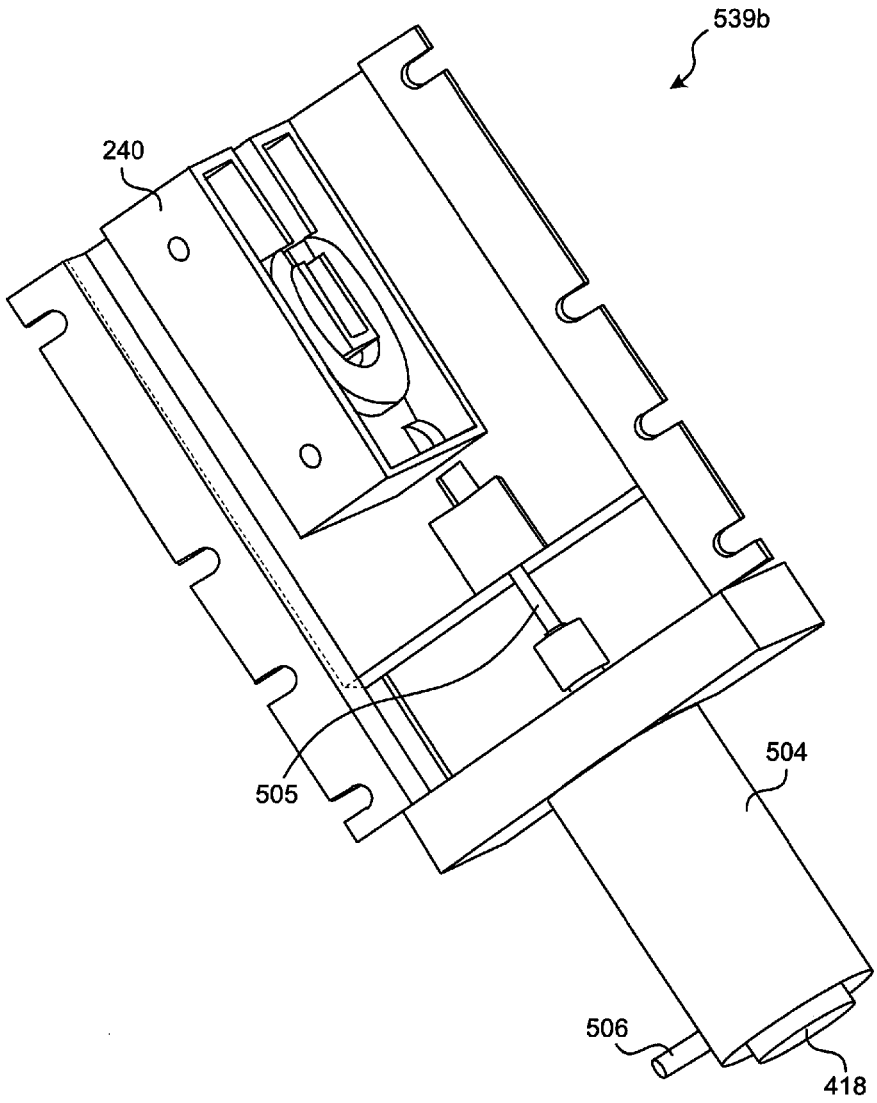
Figure 5C:
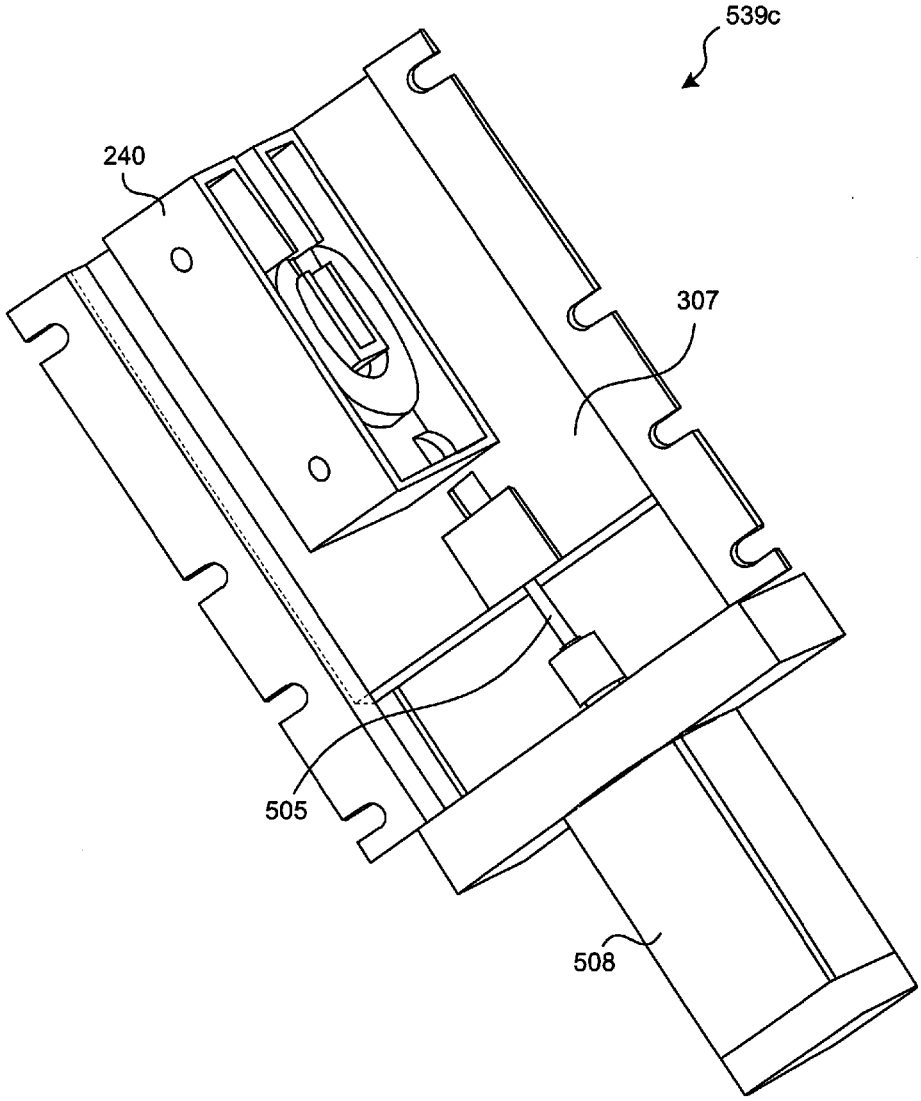

Although the moving device embodiments described above include the motor 412, a variety of additional or alternative moving devices can be used to alter the position of the second coin sensor 240 relative to the coin path 148. FIGS. 5A-C, for example, are partially schematic front views of auto-positioning sensor assemblies configured in accordance with other embodiments of the present disclosure. The sensor assembly 539*a* of FIG. 5A, for example, includes a solenoid 502 (e.g., a linear solenoid or a rotary solenoid) operably coupled to the circuit board 307 and the attached second coin sensor 240 via a connecting arm 505. In embodiments where the solenoid 502 provides rotary motion, an output shaft of the solenoid 502 can be operably coupled to a linking mechanism (e.g., a nut) that converts the rotary motion into linear motion, similar to the lead screw 416 and lead nut 410 described above with respect to FIG. 4. The solenoid 502 can be a traditional solenoid having two stable positions, or it can be a multi-position solenoid having a continuous range of positions or three or more stable positions. The sensor assembly 539*a* can operate in a manner at least generally similar to that described above with respect to the sensor assembly 139 of FIGS. 1B-4. For example, a signal can be sent to the solenoid 502 that energizes the solenoid 502 and moves the second coin sensor 240 to a desired position relative to the coin path 148.

FIG. 5B illustrates a sensor assembly 539*b* having a cylinder 504 in accordance with another embodiment of the present disclosure. A piston (not shown) can be slidably positioned in a cylinder 504, and operably coupled to the second coin sensor 240 via the connecting arm 505. In one embodiment, the cylinder 504 can include a port 506 for air to flow into and out of the cylinder 504 and pneumatically drive the piston and the second coin sensor 240. A return spring (not shown) can act to bias the piston in the direction of $D_1$ or $D_2$; the encoder 418 can provide an indication of position; and an air supply (not shown) can provide air at an appropriate pressure to overcome the spring and position the piston and the second coin sensor 240 in a desired position. In another embodiment, the cylinder 504 can be hydraulically operated, and the port 506 can provide a path for a hydraulic fluid to flow into and out of the cylinder 504. In the illustrated embodiment, the cylinder 504 is a single acting cylinder having a single port 506. In other embodiments, the cylinder 504 can be a double acting cylinder having two ports, and air or hydraulic fluid can be provided to move the piston in the direction of $D_1$ and $D_2$.

FIG. 5C illustrates a sensor assembly 539*c* having a piezoelectric actuator 508. The piezoelectric actuator 508 can be a piezoelectric stack, a piezoelectric rotary motor, a piezoelectric inchworm motor, or any other suitable piezoelectric device. In embodiments where the piezoelectric actuator 508 provides rotary motion, an output shaft of the actuator 508 can be operably coupled to a linking mechanism that converts the rotary motion into linear motion, similar to the lead screw 416 and lead nut 410 described above with respect to FIG. 4. The piezoelectric actuator 508 can be operably coupled to the second coin sensor in a variety of manners. In the illustrated embodiment, the connecting arm 505 extends from the piezoelectric actuator 508 and is operably coupled to the second coin sensor 240 via the circuit board 307. The sensor assembly 539*c* can operate in a manner at least generally similar to the sensor assemblies 139, 539*a* and 539*b* described above. For example, a signal can be delivered to the piezoelectric actuator 508 to move the coin sensor 240 to a desired position.

Figure 6:
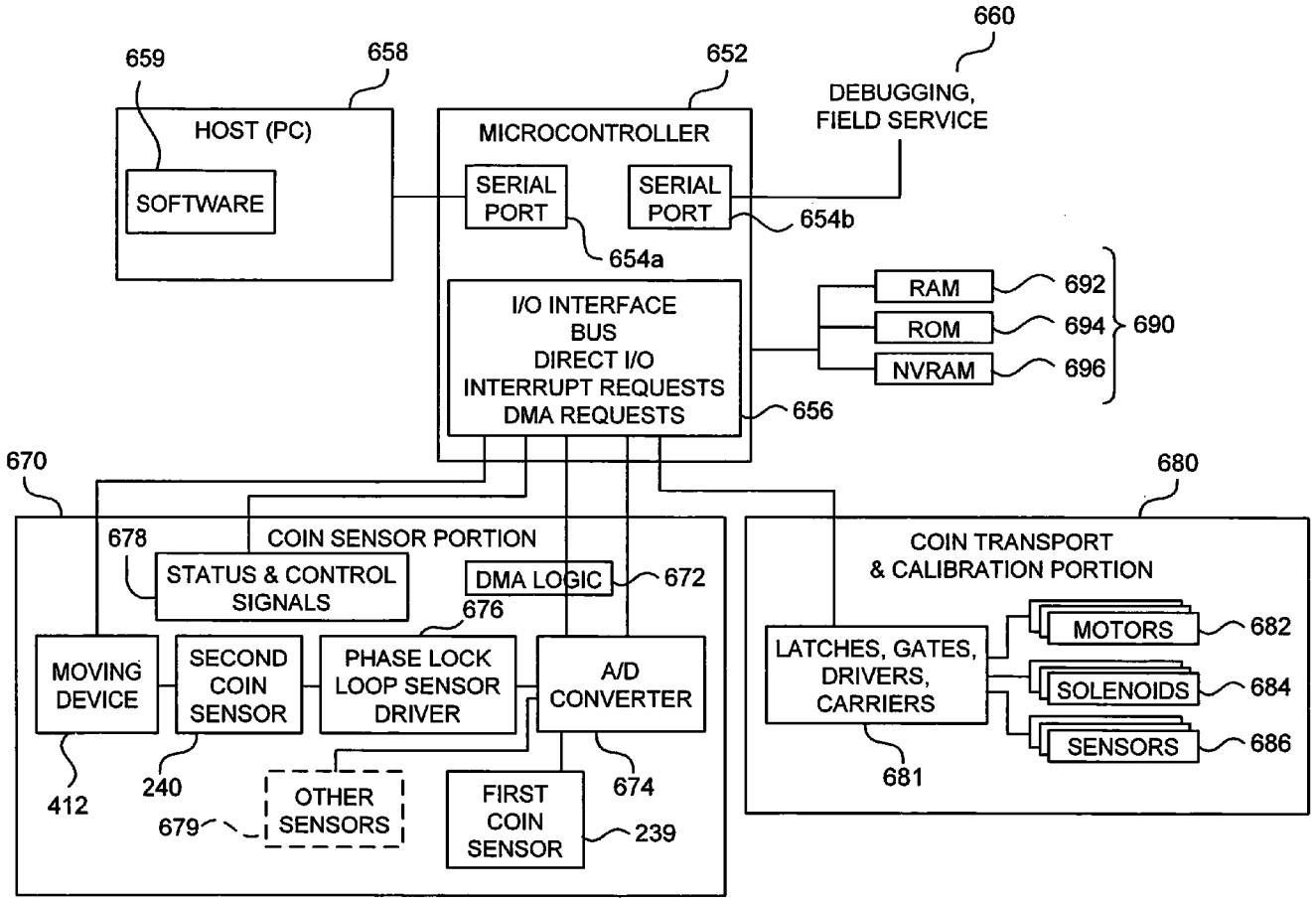
FIG. 6 is a schematic block diagram of hardware and software for a coin counting machine configured in accordance with a further embodiment of the present disclosure.

FIG. 6 is a schematic block diagram of various hardware and software components configured to control the machine 100 in accordance with an embodiment of the present technology. Various combinations of electronic control circuits, controllers, motors, solenoids, sensors, converters, drivers, logic circuitry, input/output (I/O) interfaces, connectors or ports, personal computers (PCs), computer readable media, software, and other components can be included in or connected to the machine 100 to operate and control the coin counting portion 142 and other components. In the illustrated embodiment, for example, a controller or microcontroller 652 includes a first serial port 654*a*, a second serial port 654*b*, and an I/O interface bus 656. Although the illustrated embodiment includes serial ports 654, other embodiments may include USB ports, IEEE 1394 ports, Bluetooth transmitters/receivers, or other suitable connection interfaces. The serial ports 654 can connect the microcontroller 652 to additional components, such as a host computer or PC 658 to install or update software 659, or can allow connections for operations such as field service or debugging 660. The microcontroller 652 can include memory 690, e.g., random access memory (RAM) 692, read-only memory 694, and/or non-volatile random access memory (NVRAM) 696. The memory 690 can store software and data that can be executed or utilized by the microcontroller 652 to control various operations of the machine 100. The I/O interface bus 656 can be operably connected to a coin sensor portion 670 and a coin transport and calibration portion 680 to operate various components of the machine 100, as described further below.

The coin sensor portion 670 can include direct memory access (DMA) logic 672, an analog-to-digital (A/D) converter 674 and a phase lock loop sensor driver 676 that can be used to operate various sensors and devices. For example, status and control signals 678 can report device and/or sensor status, and/or can operate the moving device 412, the first coin sensor 239, the second coin sensor 240, and/or other sensors 679. In one embodiment, a program stored in the memory 690 can direct a control signal 678 through the I/O interface bus 656 to the moving device 412. The control signal 678 can include the second signal (discussed above) and can be directed to the moving device 412 to position the second coin sensor 240 in a desired position, as described above. The coin transport and calibration portion 680 can include various latches, gates drivers and carriers 681 that can be driven, moved, or sensed by motors 682, solenoids 684 and sensors 686 to facilitate coin movement and discrimination. Similar to the components of the coin sensor portion 670, the various components of the coin transport portion 680 can be controlled by the microcontroller 652. For example, a signal from the microcontroller 652 can be sent through the I/O interface bus 656 to energize one of the motors 682 to drive the rotating disc 237 (FIG. 2). As discussed above, the rotation of the rotating disc 237 can transport coins to the coin rail 148.

From the foregoing, it will be appreciated that specific embodiments have been described herein for purposes of illustration, but that various modifications may be made without deviating from the spirit and scope of the various embodiments of the disclosure. Hence, although certain embodiments of the present technology are described herein in the context of auto-positioning coin sensors for use in consumer and non-consumer coin counting machines, those of ordinary skill in the art will appreciate that the various structures and features of the auto-positioning coin sensors described herein can also be utilized in a wide variety of other coin handling machines, including gaming devices (e.g., slot machines), vending machines, bus or subway "fare boxes," etc. Furthermore, it is within the scope of the present disclosure to provide other types of moving devices or mechanisms for auto-positioning coin sensors. For example, a coin sensor can be mounted on a rotating disc that is coupled to a motor. Additionally, other electrical, mechanical, or electromechanical devices can be employed in the auto-positioning coin sensors of the present disclosure.

Further, while various advantages and features associated with certain embodiments of the disclosure have been described above in the context of those embodiments, other embodiments may also exhibit such advantages and/or features, and not all embodiments need necessarily exhibit such advantages and/or features to fall within the scope of the disclosure. Accordingly, the disclosure is not limited, except as by the appended claims.

I claim:

1. A system for discriminating between coin and non-coin objects and determining coin denominations, the system comprising:

a coin sensor for determining a physical characteristic of an object; and a moving device operably coupled to the coin sensor, the moving device configured to automatically adjust the position of the coin sensor to determine the physical characteristic, in response to a signal based on detection of the object.

2. A system for discriminating between coin and non-coin objects and determining coin denominations, the system comprising:

a coin sensor for determining a physical characteristic of an object;

a moving device operably coupled to the coin sensor, the moving device configured to automatically adjust the position of the coin sensor to determine the physical characteristic;

a detection sensor for measuring a dimension of the object;

a coin rail, wherein the coin sensor and the detection sensor are positioned adjacent the coin rail; and a controller electrically coupled to the coin sensor and the detection sensor, the controller configured to 1) receive a first signal from the detection sensor, the first signal being indicative of the dimension of the object, and in response to receiving the first signal, 2) send a second signal to the moving device to adjust the position of the coin sensor.

3. The system of claim 2 wherein the moving device is configured to automatically move the coin sensor perpendicular to the coin rail in response to the second signal.

4. The system of claim 1, further comprising means for determining a dimension of the object, wherein the moving device automatically adjusts the position of the coin sensor based on the dimension of the object.

5. The system of claim 1 wherein the coin sensor includes a core positioned to detect an electromagnetic property of the object.

6. The system of claim 1, further comprising a circuit board having circuitry for operation of the coin sensor, wherein the coin sensor is attached to the circuit board, and wherein the moving device is an electric motor that moves the circuit board to position the coin sensor.

7. The system of claim 6, further comprising an encoder operably coupled to the electric motor to at least partially determine the position of the coin sensor.

8. The system of claim 1, further comprising a detection sensor for measuring a diameter of the object, wherein the signal is generated by the detection sensor, and wherein the moving device is further configured to align the coin sensor with the center of the object in response to the signal.

9. The system of claim 1, further comprising a circuit board and a pair of side members, the side members having guide rails for slidably receiving the circuit board, and wherein the coin sensor is attached to the circuit board and the moving device moves the circuit board to adjust the position of the coin sensor.

10. A consumer operated coin counting machine for discriminating coins, the coin counting machine comprising:

a coin path;

a first coin sensor configured to determine a first characteristic of a coin moving along the coin path;

a second coin sensor configured to determine a second characteristic of the coin moving along the coin path;

a moving device operably coupled to the second coin sensor; and a controller electrically connected to the moving device and configured to receive first information from the first coin sensor related to the first characteristic of the coin and send second information to the moving device to adjust the position of the second coin sensor to align the second coin sensor with the coin to facilitate determination of the second characteristic of the coin.

11. The coin counting machine of claim 10 wherein the second coin sensor includes a core, wherein the first characteristic is a diameter of the coin, wherein the second characteristic is an electromagnetic property of the coin, and wherein the controller is further configured to align the core with a center of the coin.

12. The coin counting machine of claim 10 wherein the moving device is a stepper motor, and wherein the coin counting machine further comprises an encoder operably coupled to the stepper motor and configured to provide an indication of the position of the second coin sensor.

13. The coin counting machine of claim 10 wherein the second coin sensor includes a core having a gap, and wherein the moving device is configured to align the gap with the coin.

14. The coin counting machine of claim 10, further comprising a circuit board and a pair of guide rails, wherein the circuit board is slidably received in the guide rails, wherein the second coin sensor is attached to the circuit board and the moving device is operably coupled to the second coin sensor via the circuit board, and wherein the moving device positions the circuit board to adjust the position of the second coin sensor.

15. The coin counting machine of claim 10, wherein the controller is configured to adjust the position of the second coin sensor based at least in part on an amount of time for the coin to travel from the first coin sensor to the second coin sensor.

16. A computer-implemented method for determining whether individual objects are coins and determining the denomination of coins, the method comprising:

moving an object along a path;

measuring a dimension of the object with a first coin sensor positioned proximate the path;

automatically adjusting the position of a second coin sensor positioned adjacent the path, based at least partly on the dimension of the object; and determining a physical characteristic of the object with the second coin sensor to determine whether the object is a coin and, if so, the denomination of the coin.

17. The method of claim 16 wherein measuring a physical characteristic of an object includes measuring a diameter of the object, and wherein adjusting the position of the second coin sensor includes aligning the second coin sensor with a center of the object.

18. The method of claim 16 wherein adjusting the position of the second coin sensor includes sending a signal to the second coin sensor at a time based at least partially on an amount of time for the object to travel from the first coin sensor to the second coin sensor.

19. The method of claim 16 wherein adjusting the position of the second coin sensor includes providing an indication of the position of the second coin sensor via an encoder.

20. The method of claim 16 wherein determining a physical characteristic includes determining an electromagnetic property of the object by directing the object through a gap in a core of the second coin sensor.

21. The method of claim 16 wherein measuring a dimension of an object and determining a physical characteristic of an object includes directing a coin along a coin rail past the first coin sensor and past the second coin sensor.

* * * * *